US005343021A

United States Patent [19]

Sato et al.

[11] Patent Number: 5,343,021

[45] Date of Patent: Aug. 30, 1994

[54] HEATER MOUNTED ON A SUBSTRATE HAVING A HOLE PENETRATING THROUGH THE SUBSTRATE

[75] Inventors: Shigehiro Sato, Yokohama; Yoshiyuki Matsunaga, Yokosuka; Tsuyoshi Ono, Tokyo, all of Japan

[73] Assignee: Toshiba Lighting & Technology Corporation, Tokyo, Japan

[21] Appl. No.: 53,319

[22] Filed: Apr. 27, 1993

Related U.S. Application Data

[63] Continuation of Ser. No. 791,373, Nov. 14, 1991.

[30] Foreign Application Priority Data

Nov. 20, 1990 [JP] Japan ..... 2-315037

[51] Int. Cl.[5] ..... H05B 3/08

[52] U.S. Cl. ..... 219/541; 219/469; 219/216

[56] References Cited

U.S. PATENT DOCUMENTS

| | | | |
|---|---|---|---|
| 3,260,981 | 7/1966 | Elliot | 338/307 |
| 3,648,364 | 3/1972 | Endo | 338/312 |
| 4,593,181 | 6/1986 | Jensen et al. | 219/541 |
| 4,792,646 | 12/1988 | Enomoto | 174/68.5 |
| 4,851,808 | 7/1989 | Sugata et al. | 338/308 |
| 5,068,517 | 11/1991 | Tsuyuki et al. | 219/543 |
| 5,083,168 | 1/1992 | Kusaka et al. | 219/216 |

FOREIGN PATENT DOCUMENTS

| | | | |
|---|---|---|---|
| 0360418 | 3/1990 | European Pat. Off. | H05B 3/26 |
| 8908841 | 10/1989 | Fed. Rep. of Germany | H05B 1/02 |
| 0259356 | 2/1992 | Japan | B41J 2/32 |
| 2174580 | 11/1986 | United Kingdom | H05B 3/14 |

*Primary Examiner*—Bruce A. Reynolds
*Assistant Examiner*—Michael D. Switzer
*Attorney, Agent, or Firm*—Cushman, Darby & Cushman

[57] ABSTRACT

A heater that has a plate shaped substrate with two holes penetrating through the substrate. Both holes are at one end of the substrate. The heater has a heating film mounted on the surface of the substrate for generating heat. The film is made of electrically conductive material and formed into a stripe shape having a first end and a second end. The first end is located near the hole. The heater also has an end film coated on the surface of the heating film around the hole and electrically connected with the heating film for supplying electric power to the heating film. The end film has higher electrical conductivity than the heating film. The substrate has means provided at the hole for supplying the electric power to the end film. The hole enables high reliability in electrical connection between the outer terminal and the heater because of the hole and the electric power supply means at the hole.

17 Claims, 5 Drawing Sheets

HEATER MOUNTED ON A SUBSTRATE HAVING A HOLE PENETRATING THROUGH THE SUBSTRATE

This is a continuation of application Ser. No. 07/791,373, filed on Nov. 14, 1991, which was abandoned upon the filing hereof.

BACKGROUND OF THE INVENTION

1. Field of the invention

The present invention relates generally to a printed heater, and more particularly, to a printed heater having a heater base having a hole penetrating through the base.

2. Description of the related art

There have been known electronic copying machines and facsimile machines (hereinafter referred to as an "electrophotographic processing apparatuses") which are operated by an electrophotographic process.

During the electrophotographic process, toner is transferred onto a paper sheet to be transferred (hereinafter referred to as a "transfer paper sheet"). The toner transferred onto the transfer paper sheet is simultaneously heated to be fused and pressed thereagainst by a heater such as a heat roller so that the toner is fixed to the transfer paper sheet.

Recently, an electrophotographic processing apparatus which uses a different kind of heater than the heat roller is known.

The heater used in such an electrophotographic processing apparatus comprises an elongated substrate made of alumina ceramics or the like and a heating member formed into an elongated film by a well-known printing method. The heating member is made of a silver-palladium alloy and extends along the substrate. Both ends of the elongated heating member reaches to the respective ends of the substrate and therefore, the elongated heating member is formed into a belt-shape. Terminals, which are connected to a power source, are provided at the respective end portions of the heating member. The respective end portions of the heating member are covered by another film which is more electroconductive than the heating member in order to decrease the contact electric resistance between the terminals and the heating member. Since the heating member reaches momentarily about 200° to 300° C. and the instantaneous current through the heater is more than a few amperes the reliability of this contact is low as compared with the rest of the electrical circuits.

One way to increase the reliability of such an electric circuit is to increase the contact surface between the heating member and the terminal connecting to the contact surface. However, an increase of the contact surface usually causes an increase of the size of the heater and therefore is contrary to the recent demand for decreasing sizes. Any increase of the contact surface without an increase of the size of the heater may cause a short circuit somewhere.

Further, soldering or welding is commonly used for electrical connections. However, in case of connecting the terminals with the heater by soldering or welding, the films formed on the surface of the heater at both ends are likely to come off because the terminals are too large as compared with the thickness of the films. The films are too thin to be prevented from melting and coming off when large terminals are connected by soldering and welding. But since the heating member reaches momentarily at 200° to 300° C. and the instantaneous current through the heater is more than a few ampere which is 100 times as much as ordinary circuits, it is necessary to form the terminals into a large size. The reliability of these electrical connections is low as compared with ordinary electrical circuits.

SUMMARY OF THE INVENTION

It is an object of the present invention to improve reliability of electrical connections between a heater and outer terminals for supplying electric power.

To accomplish the objects described above, the present invention provides a heater, comprising:

a substrate having first side surface and second side surfaces on each side thereof and a hole penetrating therethrough;

a heating film mounted on the first side surface for generating heat, the film being made of electrically conductive material and formed into a belt-shape having first end and second end, the first end being located near the hole;

a end film coated on the first side surface around the hole and electrically connected with the heating film for supplying electric power to the heating film, the end film having higher electrical conductivity than the heating film; and, means provided at the hole for supplying the electric power to the end film.

BRIEF DESCRIPTION OF THE DRAWINGS

The present invention will be better understood with reference to the accompanying drawings, wherein same reference numerals throughout the various figures denote similar structural elements and in which.

Figure 7:
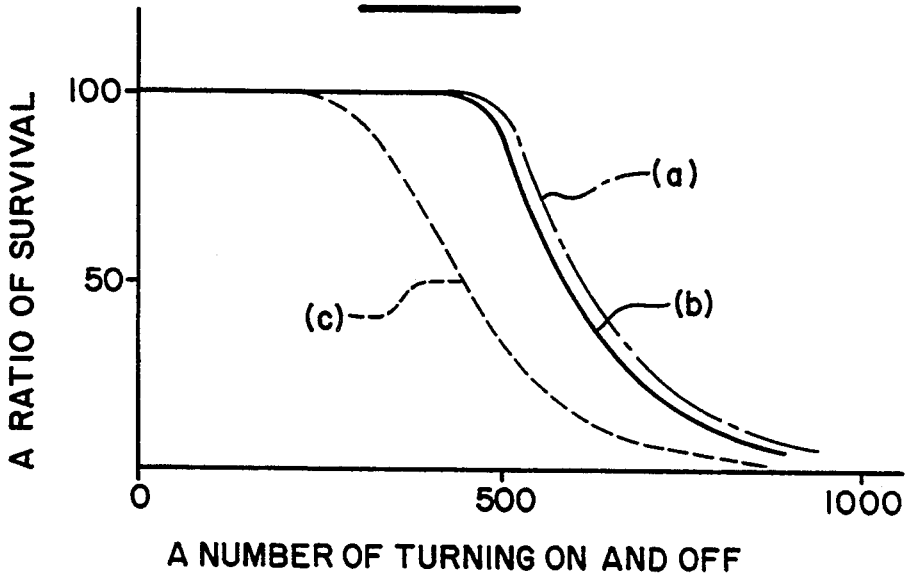
Figure 8:
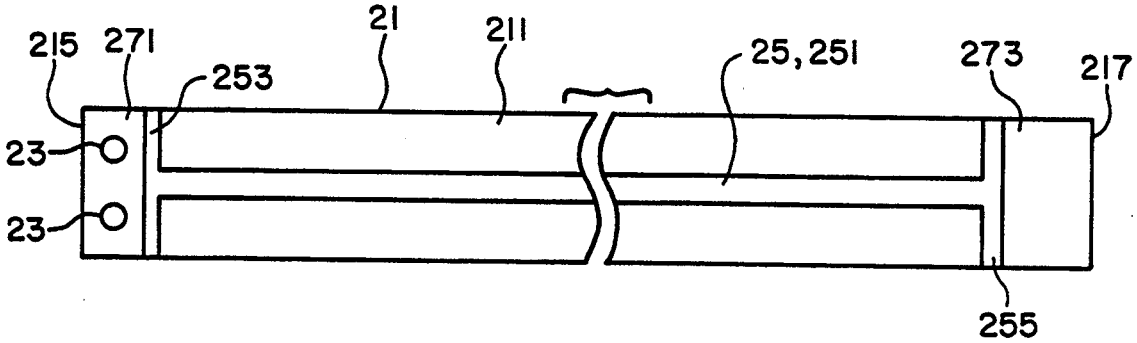
Figure 9:
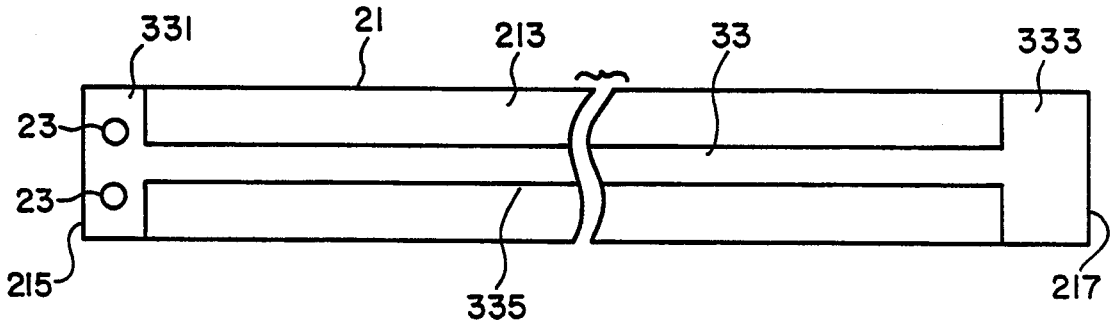
Figure 10:
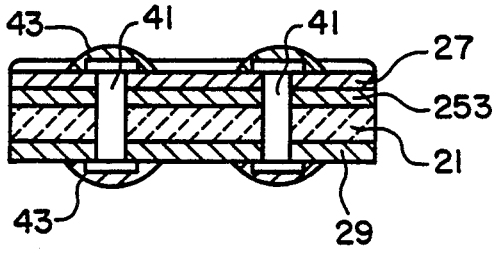
Figure 11:
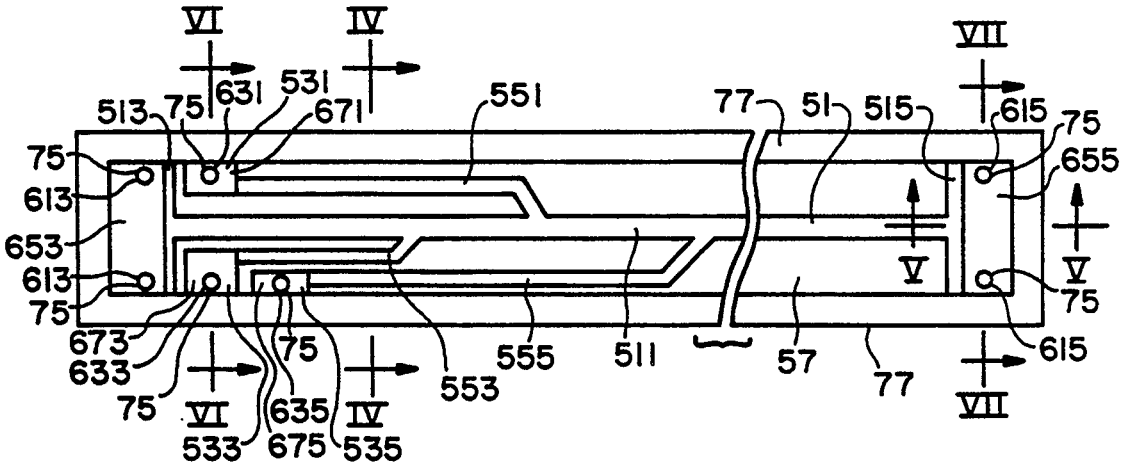
Figure 12:
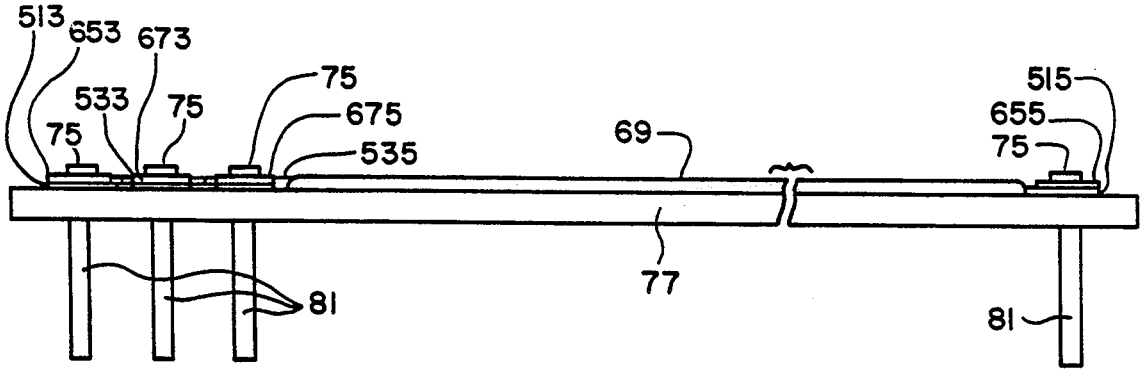
Figure 13:
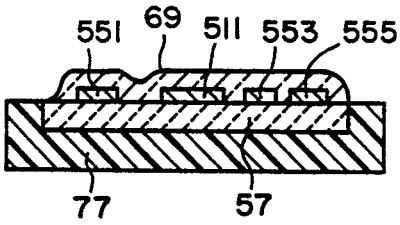
Figure 14:
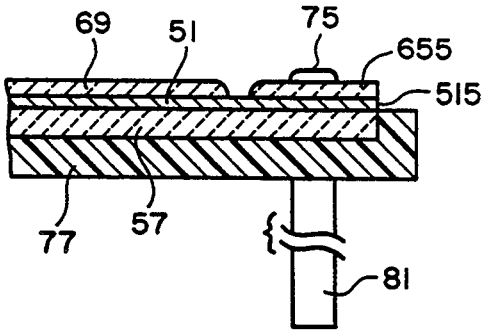
Figure 15:
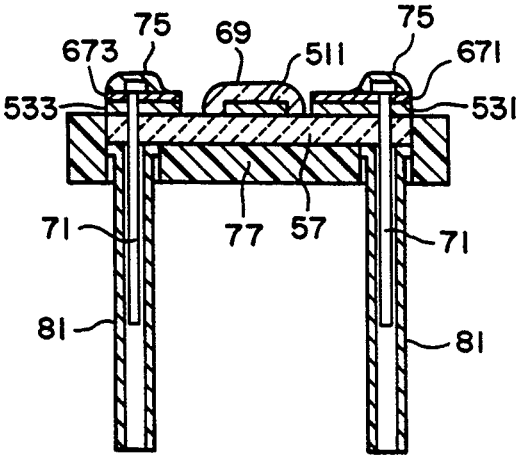
Figure 16:
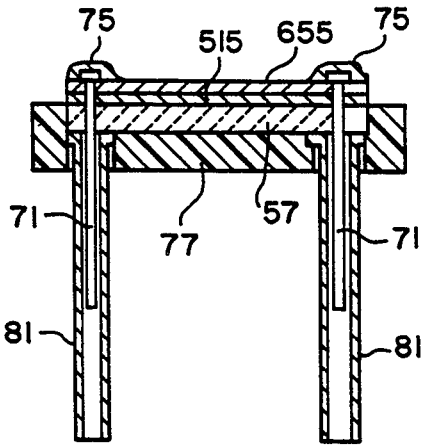
Figure 17:
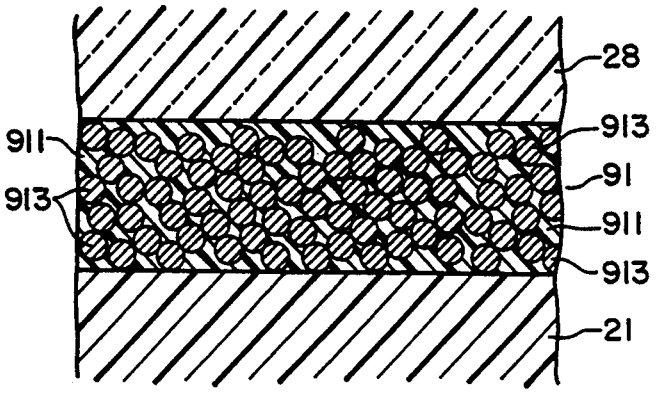
Figure 19:
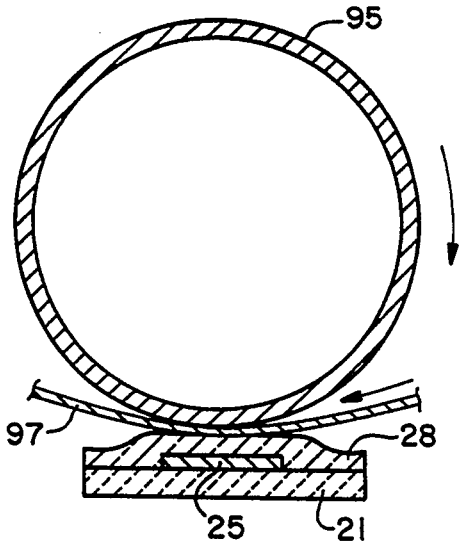
Figure 18:
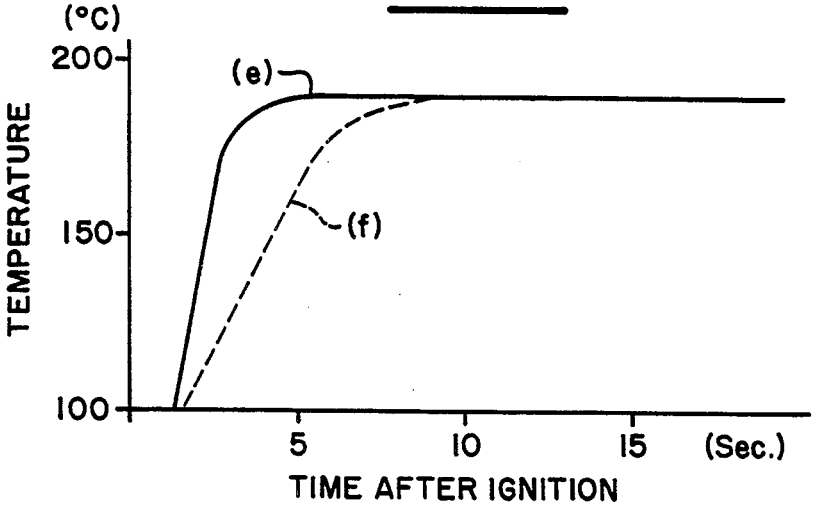

FIG .6 is a perspective view of an outer terminal;

FIG. 7 is a graph showing the results of experiments for testing reliabilities of the heaters;

FIG. 8 is a front plane view of a heater of the second embodiment of the present invention;

FIG. 9 is a rear plane view of the heater of FIG. 8;

FIG. 10 is a cross sectional view of a heater of another embodiment of the present invention;

FIG. 11 is a front plane view of a heater for another embodiment of the present invention;

FIG. 12 is a side view of the heater of FIG. 11;

FIG. 13 is a schematic cross sectional view of the heater along the line IV—IV of FIG. 11;

FIG. 14 is a schematic cross sectional view of the heater along the line V—V of FIG. 11;

FIG. 15 is a schematic cross sectional view of the heater along the line VI—VI of FIG. 11;

FIG. 16 is a schematic cross sectional view of the heater along the line VII—VII of FIG. 11;

FIG. 17 is a schematic enlarged cross sectional view of the principal part of a heater for yet to another embodiment of the present invention;

FIG. 18 is a graph showing a result of measuring increasing rates of change of temperature of the heaters; and FIG. 19 is a schematic cross sectional view of the principal part of a electrophotographic processing apparatus in which a heater of the present invention is used.

DETAIL DESCRIPTION OF THE PREFERRED EMBODIMENTS

Preferred embodiments of the present invention will now be described in more detail with reference to the accompanying drawings.

Figure 1:
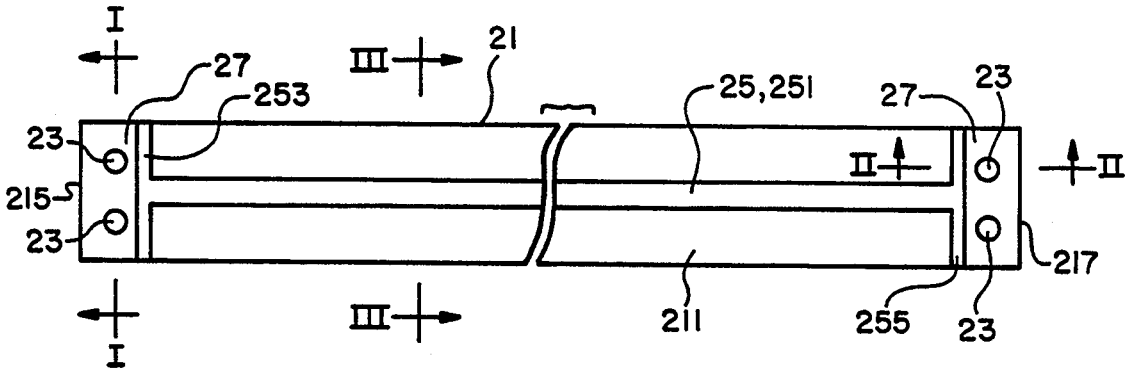
FIG. 1 is a front plane view of a heater of the first embodiment of the present invention.
Figure 2:
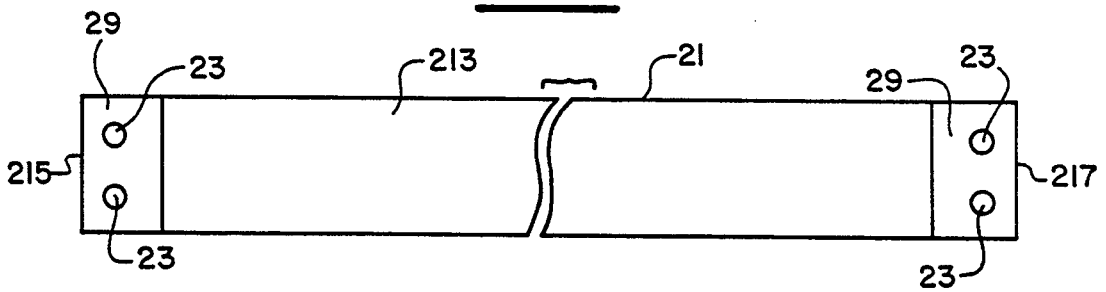
FIG. 2 is rear plane view of the heater of FIG. 1.

FIG. 1 to FIG. 5 illustrate a printed heater of the first embodiment of the present invention. FIG. 1 is a front plane view of the heater of the first embodiment and FIG. 2 is a rear plane view of the heater of FIG. 1. The heater has a substrate 21 made of alumina ceramics. The substrate 21 has a long and slender stripe shaped configuration which is 300 mm long, 20 mm wide and 1 mm thick and flat surfaces (first side surface 211 and second side surface 213). The substrate 21 has a pair of holes 23 and 23 at each end (first end 215 and second end 217) respectively. Each hole has a diameter of 0.3–1.0 mm. They are preferably located such that a line which connects the holes is perpendicular to an axis along substrate 21.

The substrate has a heating film 25 on the first side surface 211. The heating film 25 is made of silver-palladium alloy (Ag.Pd). The silver-palladium alloy (Ag.Pd) is formed on the substrate by a conventional thick printing technique and baked. The heating film 25 has a heating section 251 and a pair of terminal sections 253 and 255. The heating section 251 has a long and slender stripe configuration which is 270 mm long, 1.5–2.5 mm wide and 10 μm thick. Each of the terminal sections 253 and 255 is continuously formed on the first end 215 or the second end 217, is adjacent to each end of the heating section 251, respectively and has a rectangular shape which is about 15–20 mm wide, 10 mm long and 10 μm thick. The inner surfaces 231 of the holes 23 are covered with the silver-palladium alloy.

Figure 3:
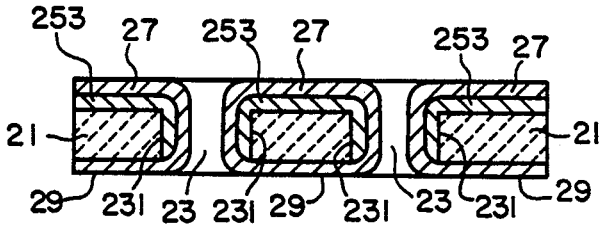
FIG. 3 is a schematic cross sectional view of the heater along the line I—I of FIG. 1.
Figure 4:
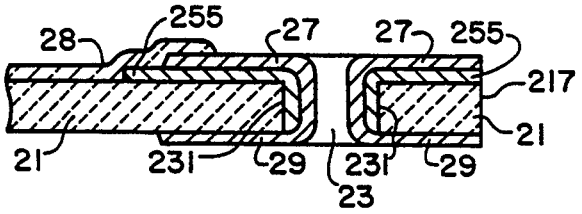
FIG. 4 is a partial schematic cross sectional view of the heater along the line II—II of FIG. 1.
Figure 5:
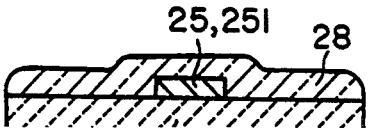
FIG. 5 is a schematic cross sectional view of the heater along the line III—III of FIG. 1.

Further, end films 27 and 27 made of conductive material are coated on the terminal sections 253 and 255 of the heating film 25, which is provided for supplying electric power to the heating film 25. Accordingly, it is necessary for the conductive material consisting of the end films 27 and 27 to have a lower electrical resistance than the heating film 25. The end films 27 and 27 are coated around the holes and cover inner surfaces of the holes 23, as shown in FIG. 3 and FIG. 4, where FIG. 3 illustrates a schematic cross sectional view of the heater along the line I—I of FIG. 1 and FIG. 4 illustrates a schematic cross sectional view of the heater along the line II–II of FIG. 1. Furthermore, a glass film 28 (not shown in FIG. 1) is coated on the first side surface 211 for protecting the heating film 25 in an area corresponding to the heating section 251 of the heating film 25, as shown in FIG. 5 illustrating a schematic cross sectional view along the line III—III of FIG. 1.

Back films 29 and 29 are coated in areas on the second side surface 213, corresponding to the end films 27 and 27 of the first side surface 211 and accordingly, are continuously coated so as to form electrical connection with the end films 27 and 27 through the holes 23. The back films 29 and 29 are made of the same conductive material as the end films 27 and 27.

Figure 6:
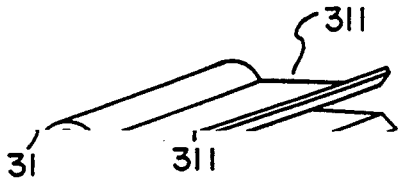

The heater described above is attached to sockets or outer terminals 31 illustrated in FIG. 6 and electric power is supplied to the heater through the sockets or the outer terminals. Each outer terminal 31 is made of electrically conductive and elastic material such as metal. Each outer terminal 31 has a pair of fins 311 and 311 and a connecting portion 313. Each terminal holds elastically the heater between the pair of fins 311 and at each end of the heater, respectively. Accordingly, both fins 311 and 311 contact the surface of the end film 27 and the surface of the back film 29. To assure proper contact between the outer terminal and the end film 27 or the back film 29, soldering or welding may be done.

The heater described above has high reliability of the connections between the heater and the outer terminals for supplying electric power, since there are holes 23 which have surfaces covered with electrically conducting material, at each end 215 and 217. The heater can receive electric power through both surfaces of the heater since both side surfaces of the substrate 21 are electrically connected with one another by the holes. Therefore, the contact area between the outer terminals 31 and the heater becomes large and conversely the contact electrical resistance between the outer terminals 31 and the heater decreases. Further, this configuration allows the size of the heater to stay small.

Furthermore, the reliability of connection between the sides of the heater increases, since the heater of the embodiment has two holes at each end. The connecting electrical resistance between both sides of the heater also decrease in the embodiment.

The number of holes provided at each end is not limited to the embodiment described above and may alternately be one, as one modification of the first embodiment.

FIG. 7 shows the results of experiments for testing reliabilities of the heaters according to the first embodiment and the modified heater of the first embodiment. The modified heater has one hole at each end and has a back film at each end. A heater which has no holes nor back films at either end and therefore has only one end film for receiving electric power is also tested as a comparison for understanding the superiority of the present invention. Line (a), (b) and (c) indicate results of the heaters according to the first embodiment, the modified heater of the first embodiment and the compared heater, respectively. Each heater was tested with a hundred samples, and under the conditions that each sample was repeatedly turned on for 15 seconds and after that turned off for 30 seconds. A ratio of survived samples is plotted in FIG. 7. A vertical axis indicates the ratio of survival and a horizontal axis indicates a number of times of turning on and off.

FIG. 7 shows that the heater of the first embodiment is the most reliable of the three. The results of these tests show that more holes increase the reliability of the heater.

Referring now to FIG. 8 and 9, a second embodiment of the printed, heater according to the present invention will be described. FIG.8 is a front plane view and FIG. 9 is a rear plane view. A substrate 21 of the heater of the second embodiment has a pair of holes 23 only at a first end 215 and does not have any holes at a second end 217. Instead the heater has a back film 33 coated on a second side surface 213 and formed into a long and slender configuration similar to a heating film 25 coated on a first side surface 211. Sizes of the substrate, heating film and holes are the same as the heater of the first embodiment. Materials of the heating film 25 and the back film 33 are also the same as the heater of the first embodiment. The back film 33 has a first wide section 331 at the first end 215, a second wide section 333 at the second end 217 and a connecting section 335 electrically connecting the wide sections 331 and 333. First end film 271 is coated on the first terminal section 253 of the heating film 25 at the first end 215 and connected electrically with the first wide section 331 of the back film 33. Second end film 273 is also coated on the second terminal section 255 of the heating film 25 at the second end 215. Other structural elements of the heater of the second embodiment are the same as those of the heater of the first embodiment. Accordingly, current flows from the second end film 273 to the second wide portion 333 of the back film 33 through the second terminal section 255, the heating section 251, the first terminal section 253, the first end film 271, the first wide section 331 and the connecting section 335. The resultant current flow is therefore through the holes 23 and 23.

The heater described above has a advantage in that the heater has a pair of terminals for receiving electric power only at one end and the other end does not need a terminal. Further the heater described above has another advantage in that the substrate is small, since the back of the substrate has a electrical circuit for allowing current to flow and a terminal for receiving electric power. In other words, the substrate is small, since both terminals are not provided on one side surface of the heater.

Means for connecting electrically both sides of the substrate is not limited to the embodiments described above. Another structure for the electrical connection, as an alternative to the hole-plating technique, is shown in FIG. 10. FIG. 10 illustrates a schematic cross sectional view of a heater of this embodiment and corresponds to FIG. 3 of the first embodiment. The heater has a terminal rod such as a rivet 41 at each hole 23 respectively for connecting electrically each end film 27 with each back film 29 through the rivet 41. In this embodiment, the rivet 41 is connected to the end film 27 and the back film 29 by soldering 43 for improving the reliability of electrical connections among the rivet 41, the end film 27 and the back film 29.

A heater according to a third embodiment of the present invention is described in FIG. 11–FIG. 16. The heater has a heating film 51 which has a heating section 511, a plurality of terminal sections 513, 515, 531, 533 and 535 and branch sections 551, 553 and 555 electrically connecting the heating section 511 with the terminal sections 531, 533 and 535. Areas of the heating section generating heat are changed according to the terminal sections that are selected in order to be energized. Therefore, it is possible to change the areas generating heat corresponding to sizes of transfer paper sheets applied to an electrophotographic processing apparatus.

The heating film 51 is formed on a substrate 57 by a well known printing technique and the heating section 511, the terminal sections 513, 515, 531, 533 and 535 and the branch sections 551, 553 and 555 are formed continuously and at the same time. The substrate has a plurality of holes 613, 613, 615, 615, 631, 633 and 635 corresponding to the terminal sections 513, 515, 531, 533 and 535. A plurality of end films 653, 655, 671, 673 and 675 are coated on the surface of the terminal sections 513, 515, 531, 533 and 535. A glass film 69 is coated on the first side surface of the heater in an area other than the terminal sections 513, 515, 531, 533 and 535 or the end films 653, 655, 671, 673 and 675, as shown in FIG. 12, 13, 14. The glass film 69 is omitted in FIG. 11 because showing such in FIG. 11 would make it difficult to understand.

Materials of the substrate 57, the heating film 51, the end film 653, 655, 671, 673 and 675 and the glass film 69 are the same as the heater of the first embodiment.

The heater has terminal rods 71:71 at the holes 613, 613, 615, 615, 631, 633 and 635 for receiving electric power and supplying it to the heating section 511. Each terminal rod is inserted in each hole and fixed at each hole electrically connected thereto by solder 75.

The heater has a plastic base 77 for mounting the substrate 57. The plastic base 77 is made of heat-resisting resins such as liquid crystal polymers, polyphenylsulphide, and so on. The plastic base 77 has a recess for holding the substrate 57 and base holes into which many terminal rods 71 are inserted. The plastic base 77 can reinforce the strength of the substrate.

The terminal rods 71 are made of nickel, copper and so on and have an electrical resistance which is not more than $6\times10^{-6}$ Ω/cm of length. When they are made of copper, it is necessary to have more than 0.3 $mm^2$ in sectional area. When they are made of nickel, it is necessary to have more than 0.75 $mm^2$ in sectional area. Since there is not more than $6\times10^{-6}$ Ω/cm in electrical resistance per 1 cm in length, the terminal rod can flow a large amount of current, e.g., as high as 10A, without generating any excess heat.

The plastic base 77 has a terminal tube 81 at each base hole. The terminal tube 81 is also made of nickel, copper and so on. Each terminal rod 71 is inserted into each terminal tube 81. The terminal tubes 81,81 are provided for connecting the terminal rods 71,71 with outer lead wires (not shown in the drawings) which supply electric power to the heater. After the outer lead wires are inserted into the terminal tubes 81,81, the terminal tubes 81:81 are caulked in order that the outer lead wires would be electrically connected with the terminal rods 71,71 through the terminal tubes 81,81 and would not come off.

The heater according to this embodiment has an advantage in that the reliability of the electrical connection between the heater and a power supply means such as the outer lead wires increases because the hole 613 can strongly hold a terminal such as the terminal rod 71 which is located between the heater and the power supply means.

Furthermore, because the terminal tubes are not directly connected with the end films, and therefore it is possible for the terminal tubes 81,81 to become large, especially in sectional area, without decreasing the reliability of electrical connection. In other words, if the terminal tubes are directly connected with the end films, the films may be come off. Thus, the terminal tubes 81,81 have a lower electrical resistance than the terminal rods 71,71. As a result, the terminal rod, having high electrical resistance, can be shortened in length. This causes the reliability to increase.

A substrate of the heater of the present invention is not limited to being of ceramics material. The substrate 21 of the heater may be alternately made of a heat-resisting resin such as phenol resin, liquid crystal polymer and polyphenylsulphide in case of a low current and a low heating temperature. In this case, a preferable material for a heating film is a electroconductive resin, since a silver-palladium paste needs to be baked at high temperature to form a silver-palladium alloy. FIG. 17 is a schematic cross sectional view of the heater using resin as materials of the substrate 21 and the heating film 91.

Therefore, a paste composed of resin 911 such as polyimide resin or epoxy resin and electroconductive grains 913 such as carbon dispersed in the resin is used. The resin 911 of the heating film 91 has a lower melting temperature than the resin of the substrate 21, because it is necessary to prevent the substrate 21 from melting while the resin of the heating film 91 is baked. The glass film 28 is covered on the surface of the heating film 91 for preventing the heating film 91 from wearing.

The heater made of resin has an advantage that the rate of change of the temperature is higher than that of the heater using ceramics of the substrate like the heater of the first embodiment described above. FIG. 18 shows a difference in increasing rate of change of temperature between the heater using ceramics as a substrate and the heater of FIG. 17 using resins. Line (e) shows the increasing rate of change of temperature of the heater using resins shown in FIG. 17 and line (f) shows the increasing rate of change of temperature of a heater using ceramics. The vertical axis of FIG. 18 indicates temperature and the horizontal axis of FIG. 18 indicates time after ignition.

The heater made of resin has an advantage in that it is easier to make holes in a substrate made of resins than in a substrate made of ceramics.

Furthermore, the width of the heating film of the heater of the present invention is not limited to 1.5–2.5 mm, and it may be anywhere in the range between 0.5–10.0 mm. When the width of the heating film is under 0.5 mm, the heating film is likely to snap or burn-out, because the heating film has fine flaws and the fine flaws are likely to grow and become large when the width is too small. When the width is more than 10.0 mm, it causes an area which is not used for heating papers.

FIG. 19 is a schematic cross sectional view of a heater and a counter roller in an electrophotographic processing apparatus. The counter roller 95 is usually 45–100 mm in diameter and is positioned at the front of the heater. When a transfer paper sheet 97 passes between the counter roller 95 and the heater, the paper curves. Therefore, there is a space at each side in the direction of the width. When the width of the heating film 25 is too large, the side of the heater can not contact the transfer paper sheet 97 and heat generated at that area becomes useless and is loss of energy.

Although only a few embodiments have been described in detail above, those having ordinary skill in the art will certainly understand that many modifications are possible in the preferred embodiment without departing from the teachings thereof.

All such modifications are intended to be encompassed within the following claims.

What is claimed is:

1. A heater, comprising:

a substrate having a first side surface on a first side and a second side surface on an opposite second side thereof and having a first end and a second end, and formed with at least two sets of inner surfaces at one end defining at least two holes penetrating from said first side to said second side;

a heating film mounted on said first side surface and extending between said first end and said second end for generating heat, said heating film being made of electrically conductive material and formed into a shape having a first end part and a second end part said holes being located adjacent one of said end parts;

first and second end films respectively coated on said first and second side surfaces and each electrically connected with said heating film for supplying electrical power to respective ends of said heating film, said end film having a higher electrical conductivity than said heating film; and means provided at said holes for supplying the electric power between said first and second end films.

2. The heater according to claim 1, wherein said heating film has a structure to operate at a temperature of more than 200° C.

3. The heater according to claim 1, wherein said holes have a diameter between 0.3 to 1.0 mm.

4. The heater according to claim 1, wherein said plurality of holes are all located side by side near the first end of said heating film.

5. The heater according to claim 4, wherein said heating film has a axis which extends along it and said holes are located so that a line which connects them with each other is perpendicular to said axis.

6. The heater according to claim 1, wherein said substrate has at least one additional hole located near the opposite end part of said heating film.

7. The heater according to claim 1, wherein said electrical power supplying means includes an inner film coated on said inner surfaces and electrically connected with said end film for supplying electric power to said end film.

8. The heater according to claim 7, wherein said electric power supplying means further comprises a back film coated on said second side surface and electrically connected with said inner film for supplying electric power to said inner film.

9. The heater according to claim 8, wherein said back film continuously extends to an area of said second surface corresponding to said second end of said heating film for receiving electric power near said area.

10. The heater according to claim 1, wherein said electric power supplying means further comprises a terminal rod fixed into said holes and electrically connected with said end film on said first and second side surfaces thereof.

11. The heater according to claim 10, wherein said terminal rod has an electric resistance of not more than $6\times10^{-6}$ Ω/cm.

12. The heater according to claim 10, wherein said terminal rod extends perpendicularly to said substrate.

13. The heater according to claim 12, further comprising a plastic base mounting said substrate thereon.

14. The heater according to claim 13, wherein said terminal rod penetrates said plastic base.

15. The heater according to claim 1, wherein said heating film is made of a silver palladium alloy.

16. The heater according to claim 1, wherein said heating film is made of resin containing electrically conductive grains.

17. A heater, comprising:

a substrate having a first side surface on a first side and a second side surface on an opposite second side thereof, and having a first end and a second end, and formed with at least two sets of inner surfaces at least at said first end defining at least two holes penetrating from said first side surface to said second side surface at said first end;

a heating film mounted on said first side surface for generating heat, said film being made of electrically conductive material and formed into a shape having a first end and a second end, at least said two holes being located adjacent said first end;

a end film coated on said first side surface around said two holes and electrically connected with said heating film for supplying electric power to said heating film, said end film having a higher electrical conductivity than said heating film; and, means provided at said two holes for supplying the electric power to said end film.

* * * * *